US006397560B1

(12) United States Patent
Weder

(10) Patent No.: US 6,397,560 B1
(45) Date of Patent: Jun. 4, 2002

(54) FLATTENED DECORATIVE BAG OR SLEEVE HAVING GUSSETS CONVERTIBLE TO A DECORATIVE BAG FOR HOLDING A BASKET AND METHODS

(75) Inventor: Donald E. Weder, Highland, IL (US)

(73) Assignee: Southpac Trust International, Inc., Highland, IL (US)

( * ) Notice: Subject to any disclaimer, the term of this patent is extended or adjusted under 35 U.S.C. 154(b) by 0 days.

(21) Appl. No.: 09/553,582

(22) Filed: Apr. 20, 2000

Related U.S. Application Data

(62) Division of application No. 09/092,331, filed on Jun. 5, 1998, now abandoned.

(51) Int. Cl.[7] ..... B65B 43/26; B65B 51/08

(52) U.S. Cl. ..... 53/399; 53/414; 53/416; 53/441; 53/459; 53/468; 53/469; 150/154; 217/122; 229/87.03; 383/120; 493/111

(58) Field of Search ..... 53/397, 399, 414, 53/441, 416–419, 449, 456, 459, 464, 468, 469, 137.2, 138.7, 173, 174, 594, 556, 390; 206/457, 459.5; 383/118, 120; 493/111, 386, 908; 229/87.03; 217/3 CV, 122–125; 150/154

(56) References Cited

U.S. PATENT DOCUMENTS

| | | | |
|---|---|---|---|
| 2,048,123 | A | 7/1936 | Howard |
| 2,110,612 | A | 3/1938 | Skinner et al. |
| 2,239,398 | A | 4/1941 | Palmer |
| 2,260,230 | A | 10/1941 | Olson |
| 2,323,287 | A | 7/1943 | Amberg |
| 2,648,487 | A | 8/1953 | Linda |
| 3,113,712 | A | 12/1963 | Kindseth |
| 3,215,330 | A | 11/1965 | Thomas |
| 3,380,646 | A | 4/1968 | Doyen et al. |

(List continued on next page.)

FOREIGN PATENT DOCUMENTS

| | | |
|---|---|---|
| DE | 2060812 | 11/1971 |
| FR | 2272914 | 12/1975 |

OTHER PUBLICATIONS

"A World Of Cut Flower And Pot Plant Packaging" published by Klerk's Plastic Products Manufacturing Inc., P.O. Box 145, 205 K. Hallock Ave., Middlesex, New Jersey 08846, 6 pages.

"Le Plant Sac", 550 Crocker Street, Los Angeles, CA 90013, advertisement.

"Highlander Easter Season Headquarters PACK ' N PLEASE ™ Baskets, Bunnies, Eggs and Grass", brochure by Highland Manufacturing & Sales. Co., 6 pages.

"Make Highlander® Your Headquarters for Easter & Other Holidays", brochure by Highland Manufacturings & Sales, 1991, 12 pages.

*Primary Examiner*—Stephen F. Gerrity
(74) *Attorney, Agent, or Firm*—Dunlap, Codding & Rogers, P.C.

(57) ABSTRACT

A flattened decorative bag having gussets which is convertible to a decorative bag for a basket which, when a basket is inserted therein, conforms to the shape of the basket. Methods of making and using a flattened decorative bag having gussets.

36 Claims, 12 Drawing Sheets

U.S. PATENT DOCUMENTS

| | | | | | |
|---|---|---|---|---|---|
| 3,431,706 | A | | 3/1969 | Stuck | |
| 3,510,054 | A | | 5/1970 | Sanni et al. | |
| 3,554,434 | A | | 1/1971 | Anderson | |
| 4,113,100 | A | | 9/1978 | Soja et al. | |
| 4,118,890 | A | | 10/1978 | Shore | |
| 4,189,868 | A | | 2/1980 | Tymchuck et al. | |
| 4,333,267 | A | | 6/1982 | Witte | |
| 4,400,910 | A | | 8/1983 | Koudstaal et al. | |
| 4,717,262 | A | | 1/1988 | Roen et al. | |
| 4,771,573 | A | | 9/1988 | Stengel | |
| 4,810,109 | A | | 3/1989 | Castel | |
| 4,873,814 | A | * | 10/1989 | Harris | 53/442 |
| 4,947,794 | A | * | 8/1990 | Baldwin | 150/154 |
| 4,950,196 | A | | 8/1990 | Fortune et al. | |
| 5,305,907 | A | * | 4/1994 | Richardson et al. | 150/154 |
| 5,362,152 | A | | 11/1994 | Fletcher et al. | |
| 5,456,062 | A | * | 10/1995 | Wechsler | 53/468 |
| 5,529,395 | A | * | 6/1996 | French | 229/87.03 |
| 5,553,733 | A | * | 9/1996 | Rosenthal | 150/154 |
| 5,613,312 | A | | 3/1997 | Crowell | |
| 5,743,458 | A | * | 4/1998 | French | 150/154 |
| 6,151,865 | A | * | 11/2000 | Weder | 53/461 |

* cited by examiner

FLATTENED DECORATIVE BAG OR SLEEVE HAVING GUSSETS CONVERTIBLE TO A DECORATIVE BAG FOR HOLDING A BASKET AND METHODS

CROSS-REFERENCE TO RELATED APPLICATIONS

This is a divisional of application Ser. No. 09/092,331 filed on Jun. 5, 1998 abandoned.

STATEMENT REGARDING FEDERALLY SPONSORED RESEARCH OR DEVELOPMENT

Not applicable.

BACKGROUND OF THE INVENTION

1. Field of the Invention

This invention relates to flattened bags or sleeves for containing baskets, and particularly, flattened bags or sleeves having gussets used to contain baskets, and methods of making and using same.

2. Description of Related Art Including Information Disclosed Under 37 CFR §1.97 and 37 CFR §1.98

Sheets of material have been formed into bags and decorative covers for various items. Such bags often are folded for easy shipment and storage.

Usually, however, the item placed in such a bag must be sized to fit the bag. The bag, that is, has not been formed to conform to the shape of the item placed within it. Further, when a decorative cover has been formed to conform to an item, the decorative cover often cannot be folded and flattened so that the cover can be easily shipped and stored.

The present invention contemplates bags formed from sheets of material and sleeves, which conform to the shape of an object placed within the bag, in this instance, a basket. Further, many of the bags disclosed herein have gussets, either in the side of the bag, the bottom of the bag, or both, which permit the bag to conform to the shape of the object it contains. Such gussets permit the present bag to expand and contract to closely follow the contours of the object placed within the bag. In this way, the bag closely follows the overall shape and contours of the outer surface of the object, such as a basket, placed within the bag. Further, such gussets permit the bag to be folded into a shape which makes shipping and/or storage easy, and conserving of space. The gussets also permit the bag, even if of an unusual shape when opened and expanded to receive an object, to be folded and flattened into a smaller and/or more symmetrical shape, and which again enhances ease of shipping and/or storage.

It is an objective of the present invention to provide a bag having gussets in the sides and/or bottom of the bag. It is a goal of this invention that the gussets in the bag permit the bag to be folded and flattened for storage and/or shipment. It is a further objective of the present invention to have a bag which expands when opened, forming an object retaining space. It is a further goal of this invention that the bag conforms closely to the overall shape and contours of the outer surface of an object placed within the object retaining space when the bag is opened. It is yet a further objective of the present invention that the bag conforms to the contours of the object placed within the bag when the bag is closed and/or sealed about the object.

BRIEF SUMMARY OF THE INVENTION

A flattened decorative bag for containing a basket is disclosed. The decorative bag has an upper end, a closed lower end, an outer surface, a plurality of gussets disposed between the upper end and the closed lower end, and an opening in the upper end. When the bag is placed in an opened condition, the opening is sized to receive a basket and the plurality of gussets expand to form a basket retaining space. The plurality of gussets expand to permit a basket to be received and retained in the basket retaining space. When a basket is disposed in the basket retaining space, the bag expands and contracts via the plurality of gussets and conforms to contours and an overall shape of an outer surface of the basket.

Another embodiment of a flattened decorative bag for containing a basket is also disclosed. A basket having an outer surface is provided. The decorative bag has an upper end, a closed lower end, an outer surface, a plurality of gussets disposed between the upper end and the closed lower end, and an opening in the upper end. When the bag is placed in an opened condition, the opening is sized to receive a basket and the plurality of gussets expand to form a basket retaining space. The plurality of gussets expand to permit a basket to be received and retained in the basket retaining space. The basket is disposed in the basket retaining space, and the bag expands and contracts via the plurality of gussets, the bag conforming to contours and an overall shape of the outer surface of the basket.

A flattened decorative bag assembly for containing a basket is disclosed. The decorative bag has an upper end, a closed lower end, and has at least one gusset disposed in the closed lower end, an outer surface and an opening in the upper end. When the bag is placed in an opened condition, the opening is sized to receive a basket and at least one gusset expands to form a basket retaining space. The gusset expands to permit a basket to be received and retained in the basket retaining space. When a basket is disposed in the basket retaining space, the bag expands and contracts via the gusset and conforms to contours of a lower end of the basket.

An alternative flattened decorative bag assembly for containing a basket is also disclosed. A basket is utilized which has a lower end and an outer surface. A decorative bag is used, which has an upper end, a closed lower end having at least one gusset disposed in the closed lower end, an outer surface and an opening in the upper end. When the bag is placed in an opened condition, the opening is sized to receive a basket and at least one gusset expands to form a basket retaining space. The gusset expands to permit a basket to be received and retained in the basket retaining space. The bag is disposed in the basket retaining space, and the bag expands and contracts via the gusset, the bag conforming to the contours and an overall shape of the outer surface of the lower end of the basket.

A method for covering a basket is disclosed. A basket having an outer periphery is provided. A flattened decorative bag is also provided. The flattened decorative bag has an upper end, a closed lower end, an outer surface, a plurality of gussets disposed between the upper end and the closed lower end, and an opening in the upper end. The bag is opened such that the opening is sized to receive the basket. The bag is expanded via the plurality of gussets to both form a basket retaining space and permit the basket to be disposed within and retained in the basket retaining space. The basket is disposed in the basket retaining space, the bag expanding and contacting via the plurality of gussets, the bag conforming to contours and an overall shape of the outer surface of the basket.

Another method for covering a basket is disclosed. A basket having a lower end and an outer surface is provided.

A flattened decorative bag is provided. The flattened decorative bag has an upper end, a closed lower end having at least one gusset disposed in the closed lower end, an outer surface and an opening in the upper end. The bag is opened such that the opening is sized to receive the basket. The gusset is expanded to both form a basket retaining space and permit the basket to be disposed within and retained in the basket retaining space. The basket is disposed in the basket retaining space, the bag expanding and contacting via the gusset and conforming to contours of the outer surface of the lower end of the basket.

The flattened decorative bag may further comprise a bonding material. The bonding material may comprise an adhesive bonding material, or, alternatively, a cohesive bonding material. The flattened decorative bag is constructed from a sheet of material selected from the group consisting of paper, cellophane, foil, plastic film, metallized film, fabric, fiber, burlap, and any combination thereof. The flattened decorative bag has characteristics selected from the group consisting of decorations, colorings, coatings, embossings, flockings, metallic finishes, pearlescent finishes, translucent finishes, transparent finishes, iridescent finishes, neon finishes, holographic finishes, holographic designs, opaque finishes, clear finishes, and any combination thereof. The flattened decorative bag is constructed from a sheet of material having a thickness in a range of about 0.5 mils to about 10 mils. Alternatively, the flattened decorative bag is constructed from a sheet of material having a thickness in a range of about 1.0 mils to about 8 mils. In a further alternative, the flattened decorative bag is constructed from a sheet of material having a thickness in a range of about 1.0 mils to about 5 mils. When the flattened decorative bag is opened and a basket is placed therein, the bag may be closed about a handle of the basket. Alternatively, when the flattened decorative bag is opened and a basket is placed therein, the bag may be closed about the basket via a multi-loop bow. In another alternative, when the flattened decorative bag is opened and a basket is placed therein, the bag may be closed above the level of a handle on the basket. The flattened decorative bag may comprise a plurality of side gussets. When the flattened decorative bag has a plurality of side gussets, the side gussets may comprise an excess of material comprising pleats. The flattened decorative bag may comprise at least one gusset in the closed lower end of the bag. When the flattened decorative bag has at least one gusset in the lower end, the gusset may comprise an excess of material comprising pleats.

DETAILED DESCRIPTION OF THE INVENTION

Figure 1:
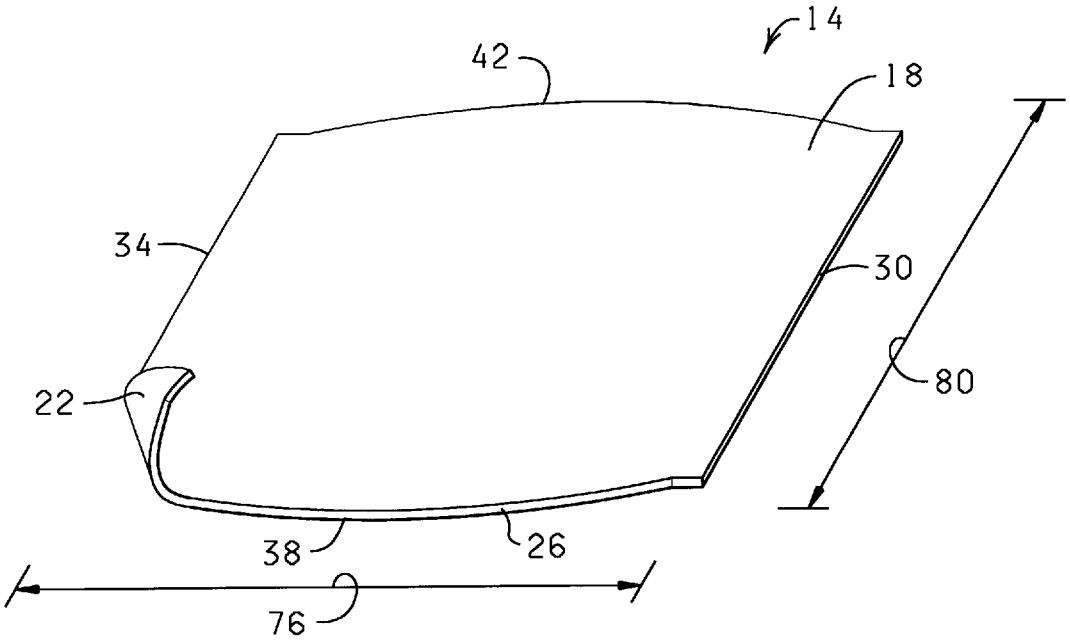
FIG. 1 is a perspective view of a first sheet of material with one end turned up for illustration purposes only, constructed in accordance with the present invention.

The Embodiments and Methods of FIGS. 1–16

Referring to FIGS. 1–16, designated generally by the reference numeral 10 is a basket bag which is constructed in accordance with the present invention. The basket bag 10 comprises a bag 12 which comprises at least one sheet of material.

Figure 2:
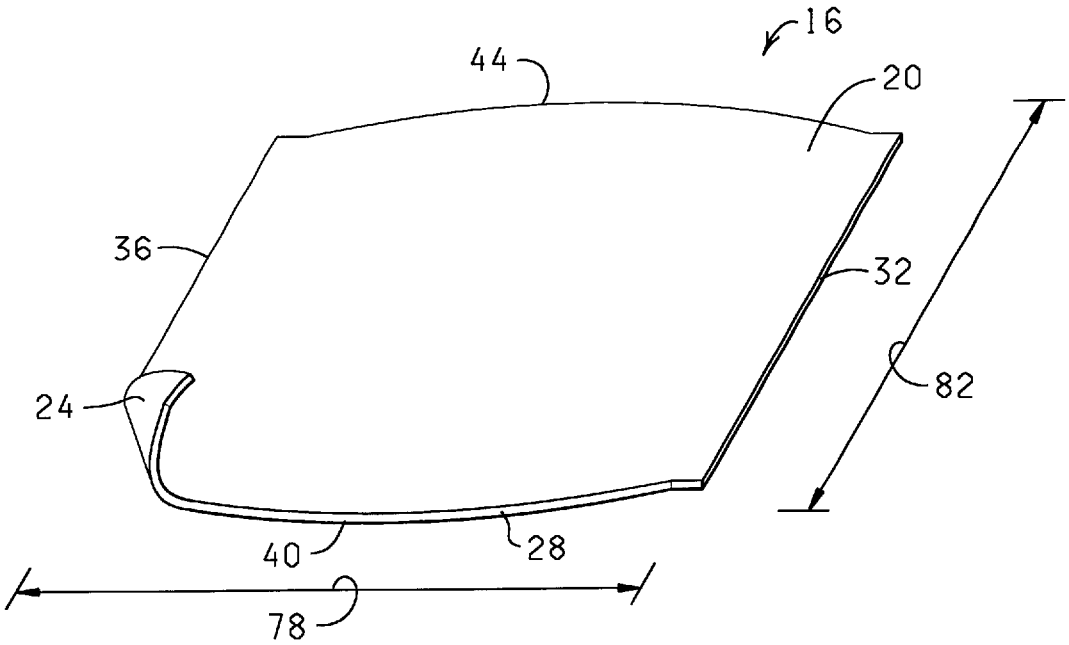
FIG. 2 is a perspective view of a second sheet of material with one end turned up for illustration purposes only, constructed in accordance with the present invention.

Such a bag 12, and all embodiments of bags shown and/or described herein, may be formed from a continuous web, may be formed from one sheet of material, may be formed from two sheets of material, or may be formed from a plurality of sheets of material. In the present embodiment, however, as shown in FIGS. 1–2, by example, but not by way of limitation, the bag 12 is formed from a first sheet of material 14 and a second sheet of material 16. The first and second sheets of material 14 and 16 each, respectively, have an upper surface 18 and 20, a lower surface 22 and 24, and an outer periphery 26 and 28. The outer periphery 26 and 28 of the first and second sheets of material 14 and 16 forms, respectively, a first side 30 and 32, a second side 34 and 36, a third side 38 and 40 and a fourth side 42 and 44.

The first and second sheets of material 14 and 16 are placed in alignment and connected together by any means and method described herein, or known in the art, to form the bag 12. That is, for example, but not by way of limitation, the first sides 30 and 32, respectively, are aligned and connected together. Similarly, the second sides 34 and 36, respectively, are aligned and connected together.

Figure 3:
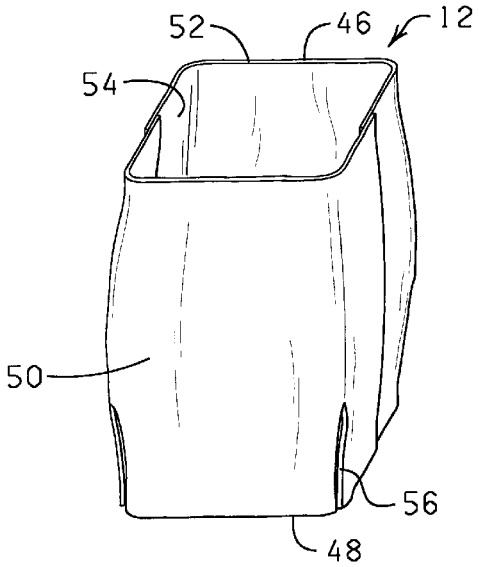
FIG. 3 is a perspective view of the first and second sheets of material connected together to form a bag of tubular shape, and having a plurality of slits formed in the lower end of the bag.
Figure 4:
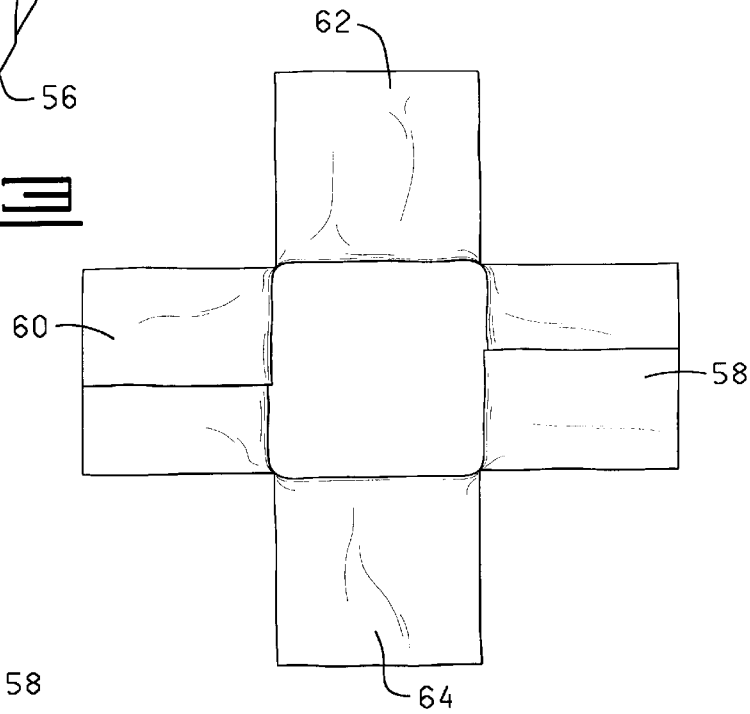
FIG. 4 is a bottom plan view of the lower end of the bag, showing the first flap, the second flap, the third flap and the fourth flap extended a distance from the bag.
Figure 5:
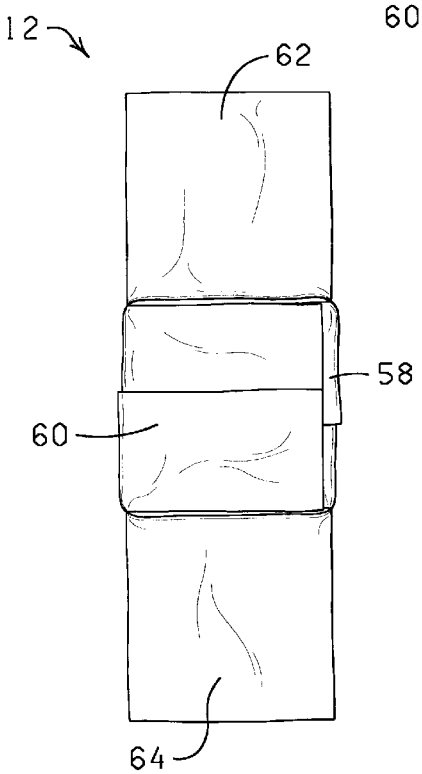
FIG. 5 is a bottom plan view of the bag of FIG. 4, but showing the first and third flaps connected together.
Figure 6:
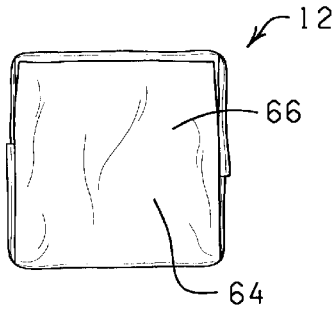
FIG. 6 is a bottom plan view of the bag of FIGS. 4–5, but showing all flaps connected together, thereby forming a closed lower end in the bag.

The first and second sheets of material 14 and 16 form a somewhat cylindrical or somewhat square shape of the bag 12 (such general shapes formed when the gusset or gussets are folded inward), which has a first end 46 and a second end 48, an outer surface 50 and an inner surface 54 as illustrated in FIG. 3. An opening 52 intersects the first end 46 and extends down and through the second end 48. The second end 48 is provided with a plurality of slits 56 (only one of the plurality of slits indicated by numeral 56). The plurality of slits 56 create a first flap 58, a second flap 60, a third flap 62 and a fourth flap 64, as shown in FIG. 4. Opposing flaps, such as the first flap 58 and the second flap 60 are brought together and secured via a bonding material, or by any means and/or method shown and/or described herein, or known in the art (FIG. 5). Similarly, opposing flaps, such as the third flap 62 and the fourth flap 64 are brought together and secured by any means or method described above. The plurality of flaps 58, 60, 62 and 64 forms a closure of the second end 48 of the bag 12, thereby forming a bottom 66 of the bag 12, and a retaining space (FIG. 6)

Figure 8:
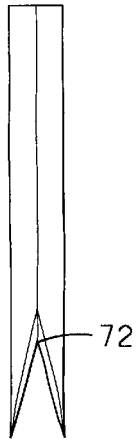
FIG. 8 is a side plan view of the bag, showing the bag in a flattened position.
Figure 9:
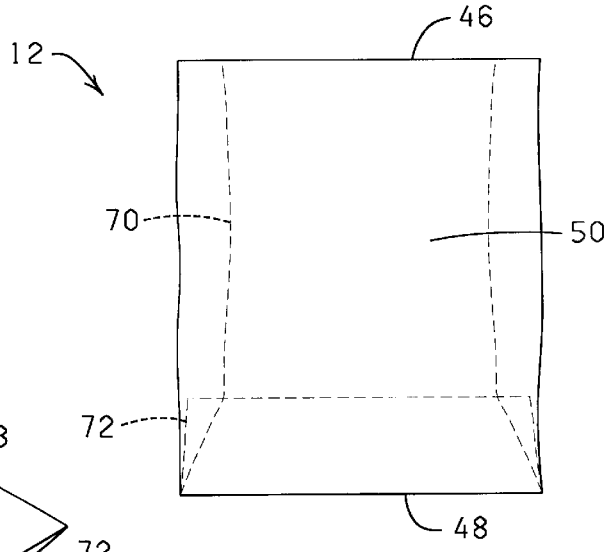
FIG. 9 is a side plan view of another side of the bag, showing the bag in the flattened position, and showing schematically a plurality of gussets in the side and the gusset in the bottom of the bag.
Figure 10:
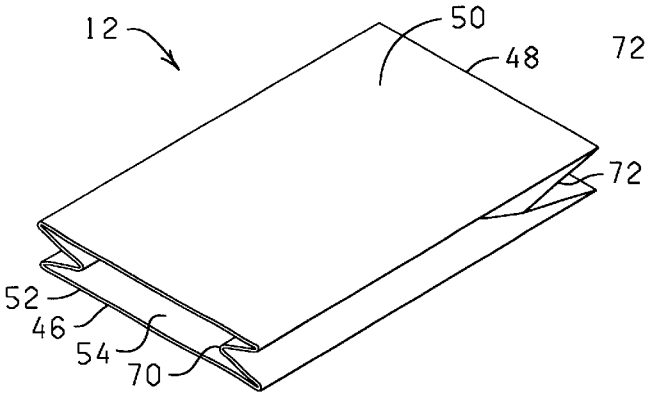
FIG. 10 is a perspective view of the bag of FIGS. 6–9, showing the bag in a closed position, the bag having both a plurality of side gussets and a bottom gusset.

The bag 12, and all embodiments of bags shown and/or described herein, after being formed, remain flattened when not opened to contain a basket. Therefore, it will be appreciated that the first sheet of material 14 and the second sheet of material 16 forming the bag 12 are disposed adjacent each other while the bag is in a flattened state, as illustrated in FIGS. 8–10. A plurality of side gussets 70 are formed (only one side gusset designated by the numeral 70), which permit the bag 12 to flatten and remain in a flattened state. The bottom 66 of the bag 12 may also have at least one gusset 72. Alternatively, however, the bottom 66 of the bag 12 may have no gussets (not shown). In a further alternative, if the bottom 66 of the bag 12 does have at least one gusset 72, the bag 12 may be formed without any side gusset 70 (not shown).

Figure 7:
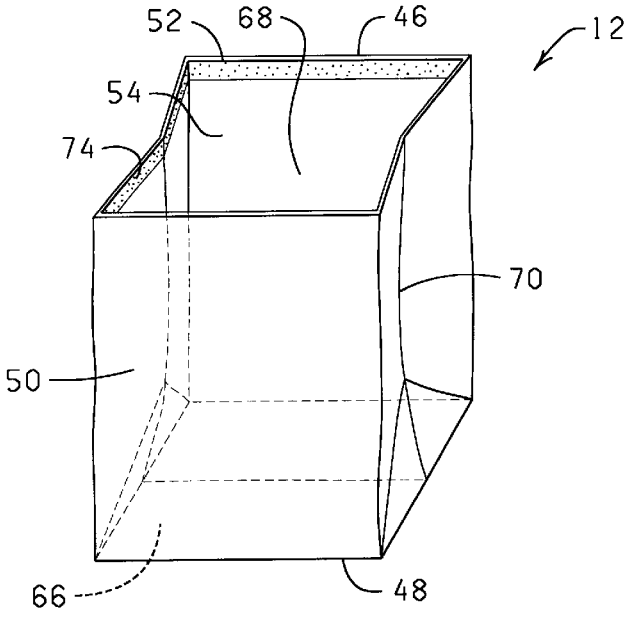
FIG. 7 is a perspective view of the bag, showing the bag in an opened, but not expanded, position.
Figure 12:
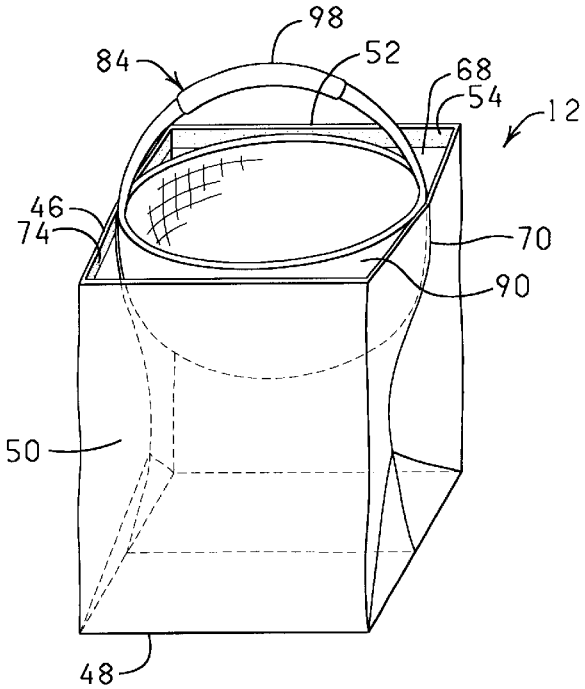
FIG. 12 is a perspective view of the bag of FIG. 9, but showing the bag in an opened position and the insertion of a basket into the bag.

To use the bag 12, and all bags shown and/or described herein, the bag 12 must be opened and held open to permit the bag 12 to form the retaining space 68 for a basket, and to permit a basket to be inserted into the retaining space 68, as shown in FIGS. 7 and 12.

Figure 13:
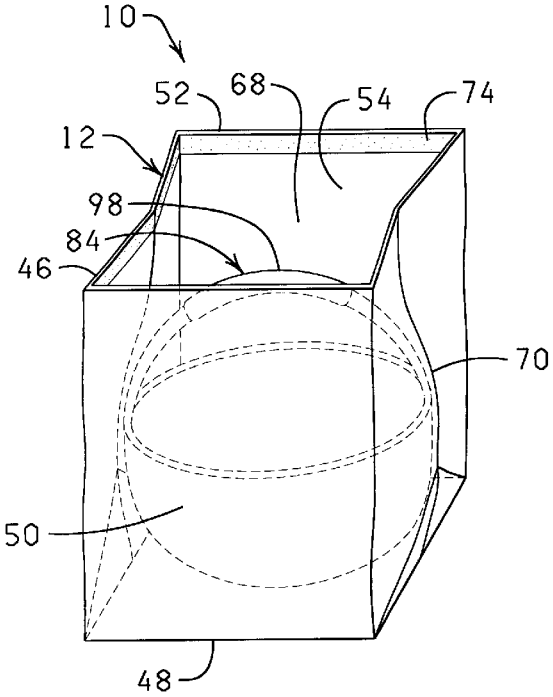
FIG. 13 is a perspective view of the bag of FIGS. 9 and 12, but showing the basket disposed into the retaining space, and showing the bag via the plurality of gussets expanding to conform to the contours of the outer surface of the basket.

A bonding material 74 may, optionally, be disposed on the first and/or second sheets of material 14 and 16, on either the upper surface 18 (FIG. 1), the lower surface 22, or both surfaces, before the bag 12 is formed, and may be utilized to connect the first and second sheets of material 14 and 16 together to form the bag 12. A bonding material 74 is often also disposed on the bag 12 after formation, as illustrated in FIGS. 7 and 12. In this instance, the bag 12 may have a bonding material 74 disposed on the outer surface 50, or, alternatively, the inner surface 54, or, in a further alternative, both surfaces. The sheets of material 14 and 16, and the bag 12, may, however, be free of a bonding material 74. In addition, bonding material may be disposed on at least a portion of a basket as well (not shown). As illustrated in FIGS. 7 and 12–13, the bonding material 74 is often disposed on the inner surface 54 of the bag 12, near the opening 52.

It will be appreciated that the bonding material 74 may also be disposed in a strip of bonding material 74, although the bonding material 74 also could be applied in the form of spaced apart spots or the bonding material 74 may be disposed on one or more surfaces of the sheets of material 14 and 16, respectively, or the bag 12, in any geometric shape, non-geometric and/or asymmetric shape, or any combination thereof, including any pattern or plurality of patterns. Further, the bonding material 74 may form at least a part, or, alternatively, all of the pattern on each of the sheets of material 14 and 16, or the bag 12. In this instance, the bonding material 74 may comprise one or more colors; the bonding material 74 may comprise one or more decorative patterns as well.

One such bonding material is described in U.S. Pat. No. 5,347,789, entitled, "Decorative Material Having A Colored Sticky Element Disposed Thereon Forming At Least A Portion Of A Decoration And Method", issued to Donald E. Weder, on Sep. 20, 1994 and which is hereby incorporated herein by reference.

Turning to the characteristics of the first and second sheets of material 14 and 16, the first and second sheets of material 14 and 16 each have a thickness in a range from about 0.1 mils to about 30 mils. Often, the first and second sheets of material 14 and 16 each have a thickness in a range from about 0.5 mils to about 10 mils. In some embodiments, the first and second sheets of material 14 and 16 each have a thickness in a range from about 1.0 mils to about 8.0 mils. In other embodiments, the first and second sheets of material 14 and 16 each have a thickness in a range from about 1.0 mils to about 5.0 mils. The first and second sheets of material 14 and 16 are each constructed of a material which is at least somewhat flexible.

The first and second sheets of material 14 and 16 may comprise any shape or combination of shapes. The first and/or second sheets of material 14 and 16 for example may be square, circular or any other geometric, non-geometric, asymmetric or fanciful shape, such as heart shaped, for example only, or any combination of geometric and non-geometric shapes. The first and/or second sheets of material 14 and 16 may be constructed of a single layer of material or a plurality of layers of the same or different types of materials. The layers of material comprising the first and/or second sheets of material 14 and 16 may be laminated together or connected together by any method known in the art.

In one embodiment, the first and/or second sheets of material 14 and 16, respectively, is a relatively thin, flexible material constructed from a plastic film. Alternatively, a paper may be utilized, alone, or in combination with other sheets of material described herein. One such plastic film (Hercules B523 oriented polypropylene packaging film (clear)), is available from Hercules Incorporated, Hercules Plaza, Wilmington, Del. 19894. Such sheets of material may be laminated together or may be connected together by any method known in the art, or may remain partially or completely unconnected.

The first and second sheets of material 14 and 16 shown in FIGS. 1–2 are constructed from any suitable material that is capable of having the characteristics and function described herein. The first and/or second sheets of material 14 and 16 may be comprised of paper (the term "paper" as used herein means treated or untreated paper, corrugated paper or cardboard or any other form of paper material). The first and/or second sheets of material 14 and 16 may comprise cellophane, foil, plastic film, metallized film, fabric (woven or nonwoven or synthetic or natural), fiber, burlap, or any combination thereof.

The term "plastic film" as used herein means a thermoplastic resinous material, such as, but not by way of limitation, a man-made polymer such as, but not by way of limitation, a polypropylene. The term "plastic film" as used herein also means a naturally occurring polymer such as cellophane. A plastic film, as contemplated and described in detail herein, is relatively strong and not as subject to tearing (substantially non-tearable), as might be the case with paper or foil.

The first and second sheets of material 14 and 16 each have a length 76 and 78, respectively, extending between the first sides 30 and 32 and second sides 34 and 36 of the first and second sheets of material 14 and 16. The first and second sheets of material 14 and 16 each also have a width 80 and 82, respectively, extending between the third sides 38 and 40 and the fourth sides 42 and 44 of the first and second sheets of material 14 and 16.

The first and second sheets of material 14 and 16 each may be constructed of a single layer of material or a plurality of layers of the same or different types of materials. One or more sheets of material may be laminated or bonded together, completely or partially, by any method known in the art. When multiple sheets of material are used, the sheets of material need not be uniform in size or shape. That is, one sheet may extend beyond at least a portion of the outer periphery of another sheet of material.

As noted earlier, a bonding material 74 may be disposed on either the first and/or second sheets of material 14 and 16, or, alternatively, on the bag 12, in any pattern or shape. One method for disposing a bonding material, in this case an adhesive, on a sheet of material is described in U.S. Pat. No. 5,111,637 entitled "Method For Wrapping A Floral Grouping" issued to Weder et al., on May 12, 1992 and which is hereby incorporated herein by reference. Another method for disposing a bonding material in order to laminate two sheets of material is described in U.S. Pat. No. 4,297,811 entitled "Laminated Printed Foil Flower Pot Wrap With Multicolor Appearance, issued to Weder on Nov. 3, 1981, which is also hereby incorporated herein by reference.

The term "bonding material" when used herein means an adhesive, possibly a pressure sensitive adhesive, or a cohesive. Where the bonding material is a cohesive, a similar cohesive material must be placed on the adjacent surface for bondingly contacting and bondingly engaging with the cohesive material. The term "bonding material" also includes materials which are heat sealable and, in this instance, the adjacent portions of the material must be brought into contact and then heat must be applied to effect the seal. The term "bonding material" when used herein also means a lacquer, which may be applied to the sheet of material and, in this instance, heat, sound waves, or vibrations, also must be applied to effect the sealing of the lacquer.

The term "bonding material" when used herein also means any type of material or thing which can be used to effect the bonding or connecting of the two adjacent portions of the material or sheet of material to effect the connection or bonding described herein. The term "bonding material" also includes ties, labels, bands, ribbons, strings, tape, staples or combinations thereof. Some of the bonding materials would secure the ends of the sheet of material while other bonding material may bind the circumference of the bag. Another way to secure the wrapping is to heat seal a portion of the material to another portion of the material. One way to do this is to contact the ends with an iron of sufficient heat to heat seal the material.

The term "bonding material" when used herein also means any heat or chemically shrinkable material, and static electrical or other electrical means, magnetic means, mechanical or barb-type fastening means or clamps, cling-type characteristics of polyethylene or curl-type characteristics of the film or materials incorporated in the sheet of material which can cause the material to take on certain shapes, and any type of welding method which may weld portions of the sheet to itself or to a basket, or to both the sheet itself and a basket.

The first and/or second sheets of material 14 and 16 may consist of designs or decorative patterns which are printed, etched, and/or embossed thereon using inks or other printing materials. An example of an ink which may be applied to either surface of a sheet of material is described in U.S. Pat. No. 5,147,706 entitled "Water Based Ink On Foil And/Or Synthetic Organic Polymer" issued to Kingman on Sep. 15, 1992 and which is hereby incorporated herein by reference. In addition, the first and/or second sheets of material 14 and 16 may have various colorings, coatings, embossings, flockings and/or metallic finishes, or other decorative surface ornamentation applied separately or simultaneously. The first and/or second sheets of material 14 and 16 may be characterized totally or partially, but not by way of limitation, by pearlescent, translucent, transparent, iridescent, neon, holographic, or the like, qualities. Each of the above-named characteristics may occur alone or in combination with other characteristics described herein, and may be applied to the upper and/or lower surface of either the first sheet of material 14 or the second sheet of material 16. Moreover, each surface of each of the first and second sheets of material 14 and 16 may vary in the combination of such characteristics. The first and/or second sheets of material 14 and 16 may also be partially or completely opaque, translucent, clear and/or tinted transparent.

Figure 11:
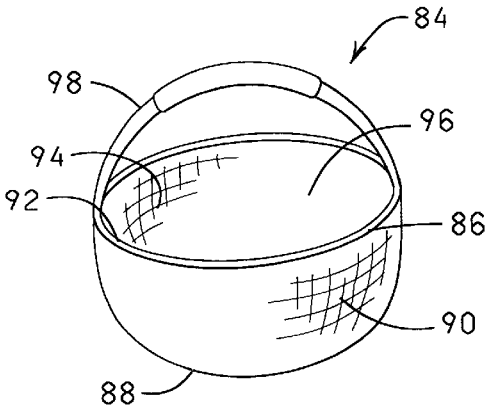
FIG. 11 is a perspective view of a basket, schematically illustrating a basket having a handle.

To use the bag 12 after formation, the bag is unflattened and held in an opened position to receive a basket 84. The bag 12 in the opened position forms the retaining space 68. A basket 84 is inserted into the retaining space 68 of the bag 12, as shown in FIGS. 12–13. Such a basket 84, as illustrated in FIG. 11, has an upper end 86, a lower end 88 and an outer surface 90. The upper end 86 is intersected by an opening 92 which forms an inner surface 94 and a basket retaining space 96. The basket 84 may also have a handle 98, or a plurality of handles (not shown), which connect to the basket 84. Alternatively, the basket 84 may have no handle (not shown).

The basket 84 may be formed from fiber, including natural fibers as well as synthetic fibers, cloth, plastic, metal, paper, wood, glass, pottery, clay, paper mache, burlap, and any combination thereof. In addition, a basket 84 formed from any material may be utilized as long as the basket performs as described herein.

In a method of use, as shown in FIGS. 11–13, the bag 12 and a basket 84 are provided, and is unflattened, and the opening 52 in the first end 46 is opened and held in an opened position. The bottom gusset 72 is expanded when the bag 12 is in an opened position, and any bottom gusset 72 is extended such that the bottom 66 of the bag 12 is flattened against the surface upon which it rests. The opening of the bag causes the bottom gusset 72 and the plurality of side gussets 70 to expand to form the retaining space 68; similarly, when the bag 12 has only a bottom gusset 72, the bottom gusset 72 must be expanded, to form the retaining space 68. A basket 84 is inserted into the opening 52 and is disposed in the retaining space 68 of the bag 12. When the basket 84 is disposed in the retaining space 68 and rests upon the bottom 66, the plurality of side gussets 70 are extended outward, in contrast to their inward folded position when the bag 12 is flattened, and in contrast to their position before the basket 84 is inserted, in which the plurality of side gussets 70 form generally level, unfolded, or, only slightly folded, sides of the bag 12. The plurality of side gussets 70 in the expanded position and/or the bottom gusset 72 in the expanded position permit the bag 12 to conform to the overall shape of the outer surface 90 of the basket 84. The plurality of side gussets 70 and/or bottom gusset 72 permit the bag 12 to conform to the contours and overall shape of the outer surface 90 of the basket by expanding and contracting, thereby permitting the bag 12 to follow the contours of the basket 84 and to conform to the contours of the outer surface 90 of the basket 84. When the bag 12 has only a bottom gusset 72, it will be understood that the bottom gusset 72 permits the bag 12 to conform to the contours of the outer surface 90 of the lower end 88 and a substantial portion of the basket 84.

Figure 14:
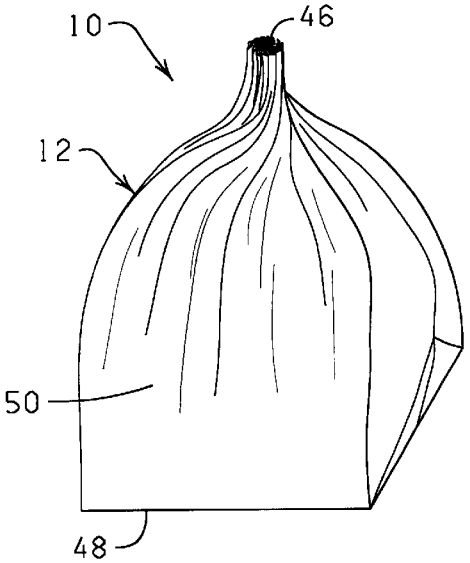
FIG. 14 is a perspective view of the bag of FIG. 13, but showing the bag closed above the level of the handle of the basket, the bag conforming to the contours of the outer surface of the basket.

In a method of closure, the first end 46 of the bag 12 may be gathered together, above the level of the basket 84 and the handle 98, as shown in FIG. 14. The first end 46 of the bag 12 may be crimped together to provide a closure of the bag 12 about the basket 84 (FIG. 14). This closure may be assisted or created by a bonding material 74 disposed about or near the first end 46 of the bag 12. It will be appreciated that the first end 46 of the bag 12 may be both crimped and twisted to create such a closure as well (not shown).

Figure 15:
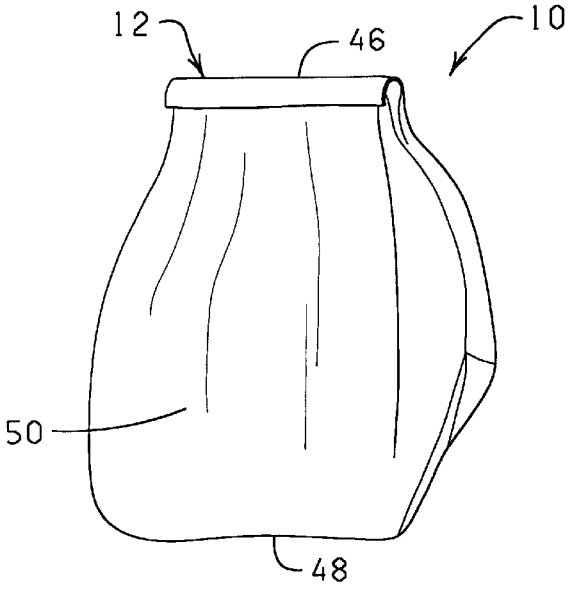
FIG. 15 is a perspective view of the bag of FIG. 13, but showing a closure of the bag above the handle of the basket, the bag conforming to the contours of the outer surface of the basket.
Figure 16:
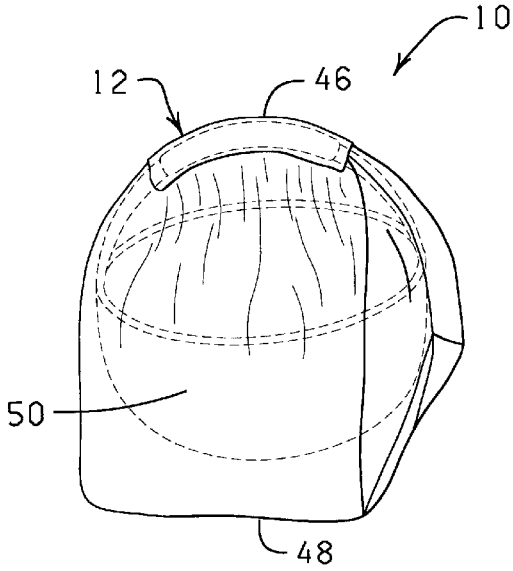
FIG. 16 is a perspective view of the bag of FIG. 13, but showing an alternative closure of the bag about the handle of the basket, the bag conforming to the contours of the outer surface of the basket.
Figure 17:
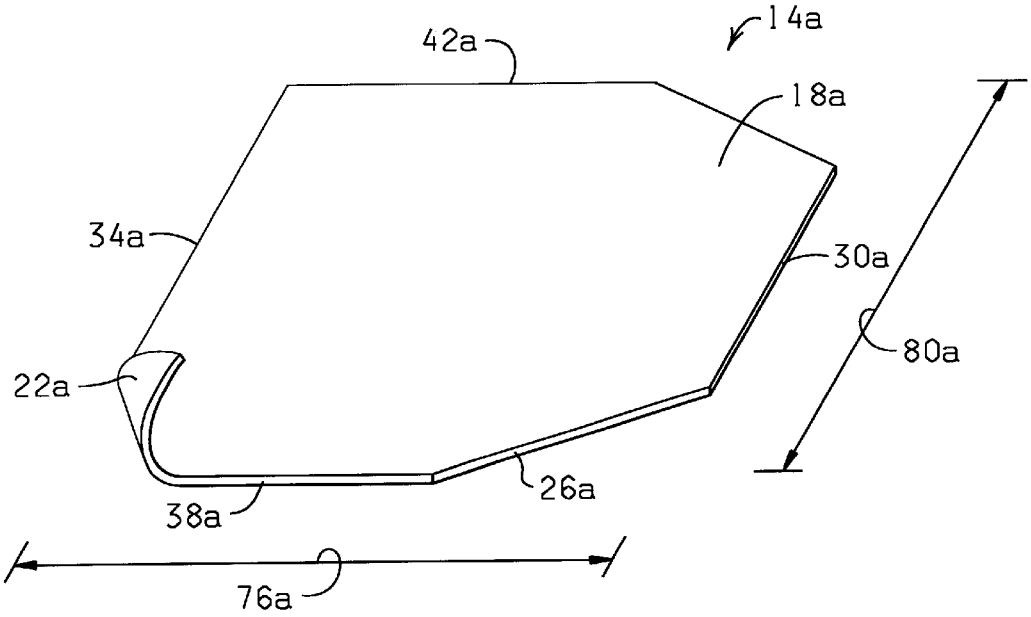
FIG. 17 is a perspective view of another first sheet of material with one end turned up for illustration purposes only, constructed in accordance with the present invention.
Figure 18:
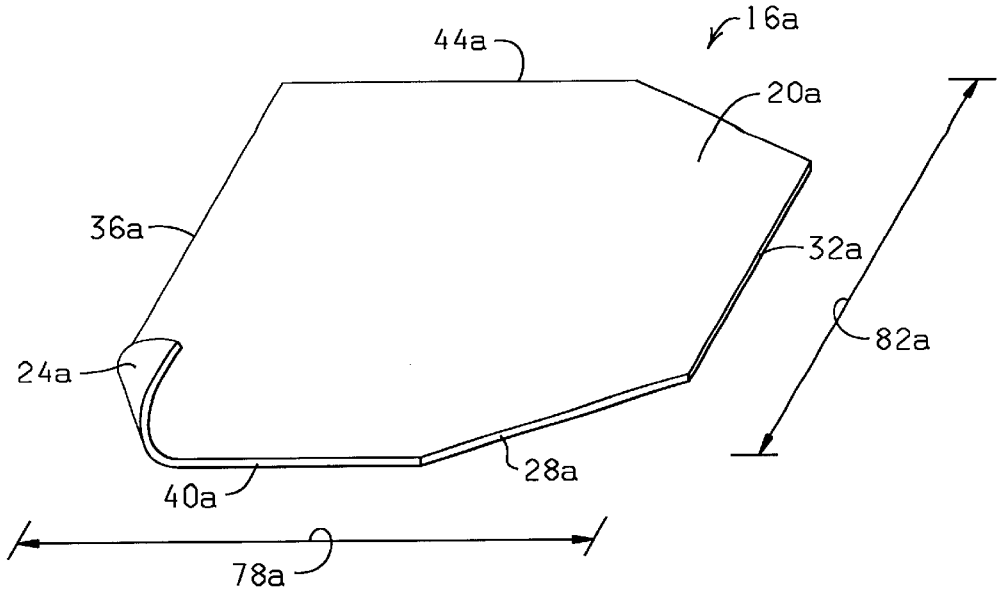
FIG. 18 is a perspective view of another second sheet of material with one end turned up for illustration purposes only, constructed in accordance with the present invention.
Figure 19:
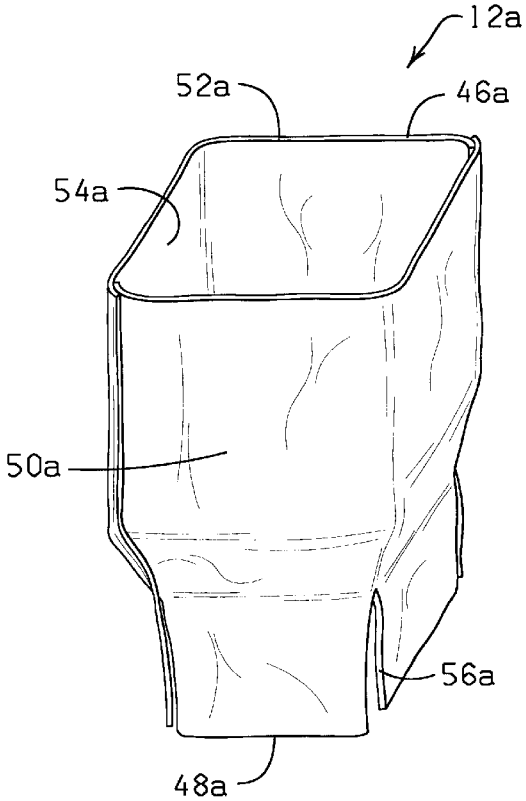
FIG. 19 is a perspective view of the first and second sheets of material of FIGS. 17–18 connected together to form a bag of somewhat tubular shape, and having a plurality of slits formed in the lower end of the tube.

Alternatively, the first end 46 of the bag 12 is flattened against itself and the first end 46 is folded over to create a closure, as illustrated in FIG. 15. The bag 12 is held in the closed position by bonding material 74, or any other means or method known in the art. In addition, in another similar alternative, the first end 46 is again flattened and folded over, but is folded adjacent the handle 98 of the basket 84, and is held in the closed position via a bonding material 74, as shown in FIG. 16. Such a closure near the handle 98 of the basket 84 permits an operator to pick up the basket 84 in the bag 12 by grasping the basket 84 from the outside of the bag 12 by the handle 98, using the thumb and fingers to hold the handle 98 of the basket 84 from the outside of the closed bag 12.

The Embodiments and Methods of FIGS. 17–28

Shown in FIGS. 17–28 is a bag 12*a* constructed from a first sheet of material 14*a* and a second sheet of material 16*a*, which is exactly like the bag 12 and formed from first and second sheets of material 14 and 16, respectively, except that the first and second sheets of material 14*a* and 16*a* have a different shape, and therefore the bag 12*a* has a different shape.

Figure 20:
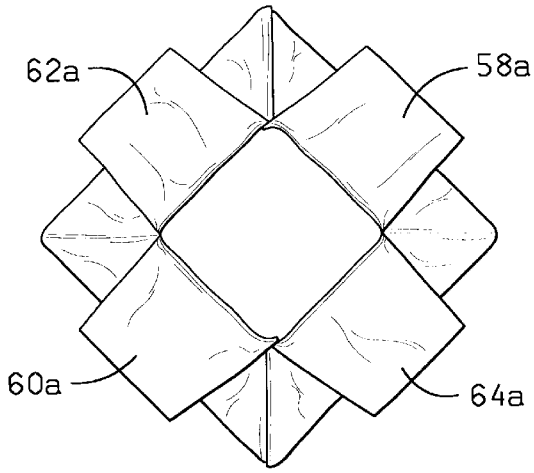
FIG. 20 is a bottom plan view of the lower end of the bag, showing the first flap, the second flap, the third flap and the fourth flap extended a distance from the bag.
Figure 21:
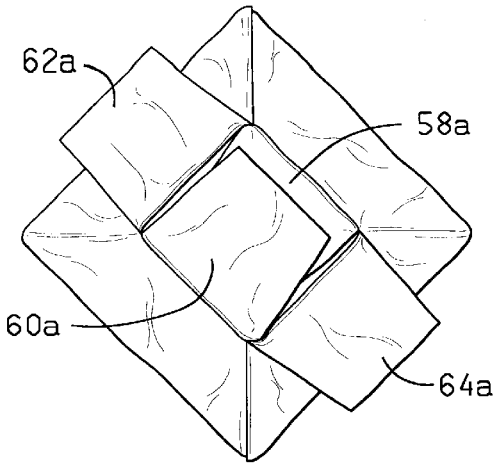
FIG. 21 is a bottom plan view of the bag of FIG. 20, but showing the first and third flaps connected together.
Figure 22:
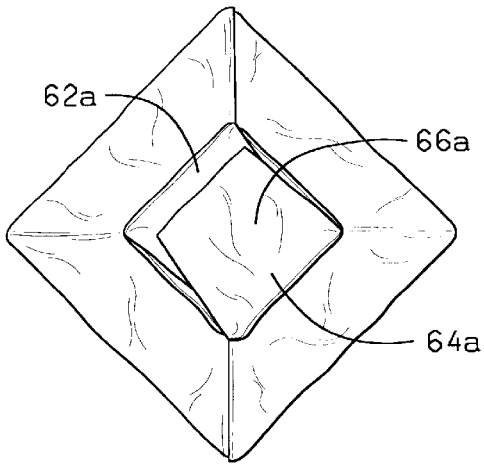
FIG. 22 is a bottom plan view of the bag of FIGS. 20–21, but showing all flaps connected together, thereby forming a closed lower end in the bag.
Figure 23:
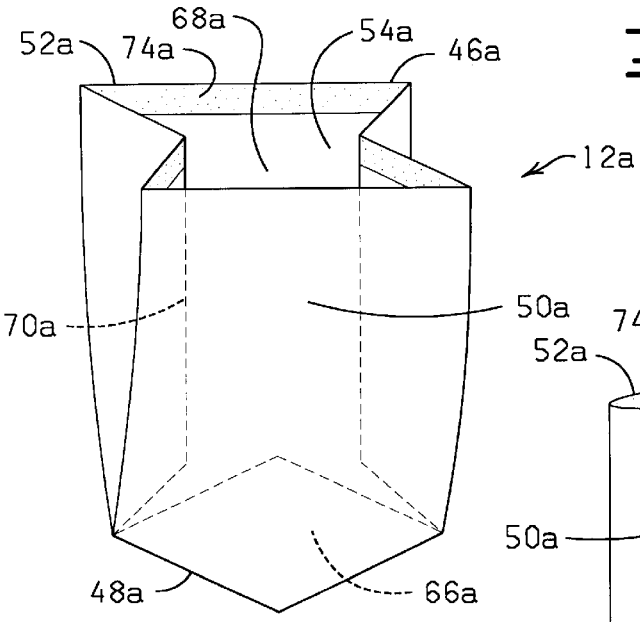
FIG. 23 is a perspective view of the bag, showing the bag in a partially flattened position, the bag having a plurality of side gussets but no bottom gusset.
Figure 24:
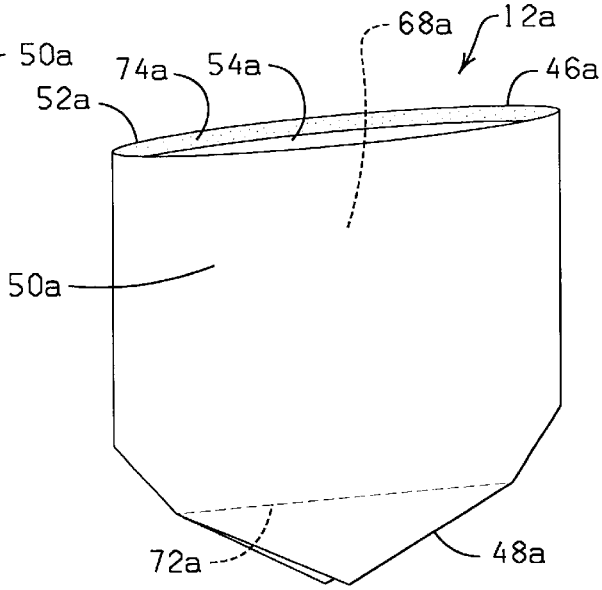
FIG. 24 is a perspective view of an alternative bag of FIGS. 17–22, but showing the bag in a partially flattened position, the bag having no side gussets but having a bottom gusset.
Figure 25:
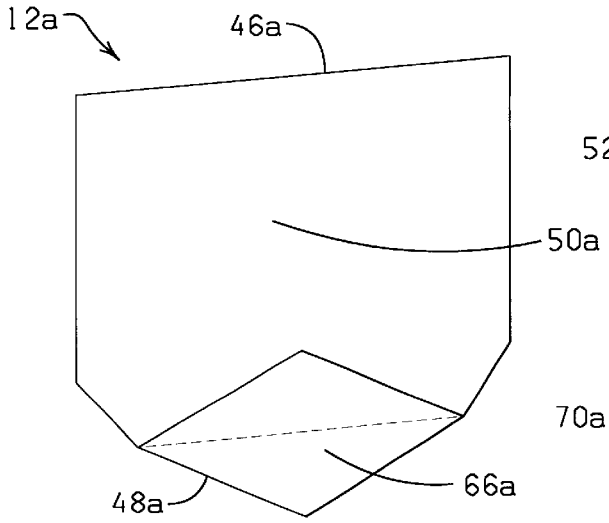
FIG. 25 is a side elevational view of yet another alterative bag, showing a bag similar to the bag of FIG. 24 but having no bottom gusset, the bag having the lower end folded over, the bag being in a flattened position.
Figure 26:
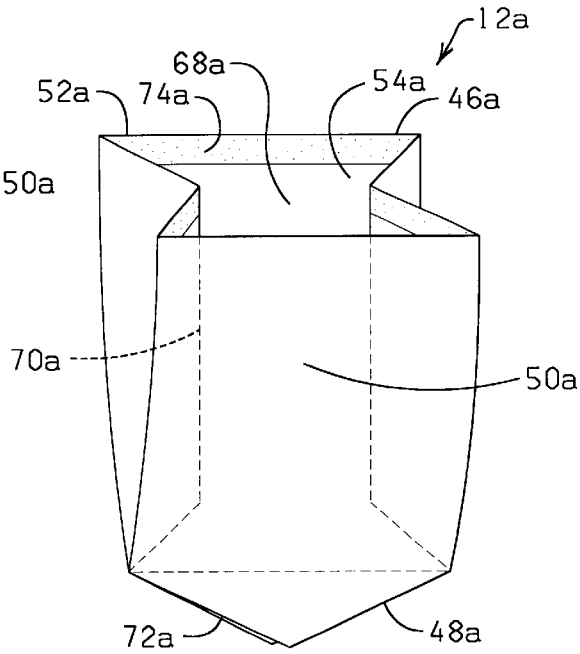
FIG. 26 is a perspective view of still yet another alterative bag, showing the bag having both a plurality of side gussets and a bottom gusset, the bag being in a folded, partially opened position.

As shown in FIGS. 17–28, the first and second sheets of material 14*a* and 16*a* have third sides 38*a* and 40*a* and fourth sides 42*a* and 44*a* which each have an outside angle of about, but not by way of limitation, 225 degrees. When the first and second sheets of material 14*a* and 16*a* are connected together (FIG. 19), the second end 48*a* has a generally trapezoidal shape, while the first end 46*a* does not. The first and second sheets of material may have, as noted above, a plurality of slits 56*a* formed in the first and second sheets of material 14*a* and 16*a* before they are connected together, or such plurality of slits 56*a* may be formed when the first and second sheets of material 14*a* and 16*a* are connected. As illustrated in FIG. 20, a first flap 58*a*, a second flap 60*a*, a third flap 62*a* and a fourth flap 64*a* are formed, and are folded over and connected in a manner similar to that described above for the first flap 58 and second flap 60, the third flap 62 and the fourth flap 64 (FIGS. 21–22) except that the resulting bottom 66*a* of the bag 12*a* formed from this closure is often, but not by way of limitation, a diamond, or, alternatively, oval shape (FIG. 22). The bag 12*a* may have a plurality of side gussets 70*a* (FIG. 23), or, alternatively, the bag 12*a* may have no side gussets (FIG. 24). Similarly, the bottom 66a may have a bottom gusset 72*a* (FIG. 24), or be formed without such a bottom gusset (FIG. 25).

In a method of use, the bag 12*a* (FIG. 26) is unflattened and opened via the opening 52*a* and held in the opened position, in a manner illustrated previously in FIGS. 7, 12 and 13. A basket 84*a* is inserted into the opening 52*a* and disposed in the retaining space 68*a*, in a manner similar to that described previously. Any bottom gusset 72*a* or plurality of side gussets 70*a* are expanded when the basket 84*a* is inserted into the retaining space 68*a* of the bag 12*a* (FIGS. 27–28).

Figure 27:
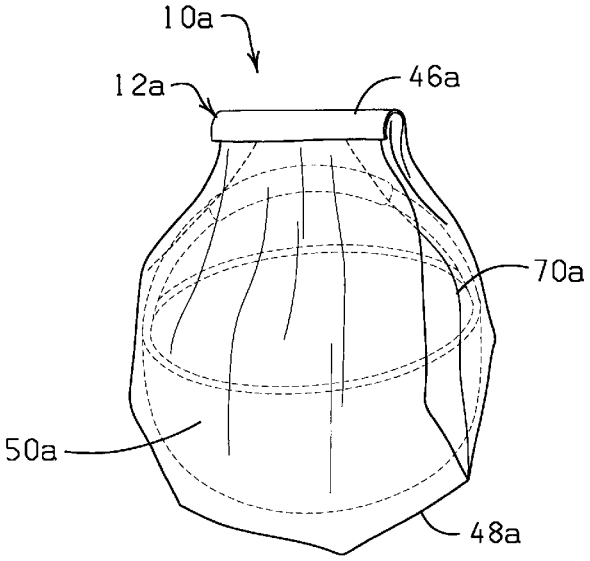
FIG. 27 is a perspective view of the bag of FIG. 26, showing the bag in a position where the bag was opened and a basket was disposed therein, the bag retaining the basket in the retaining space, the bag being closed above the level of the handle of the basket, the bag conforming to the contours of the outer surface of the basket contained therein.
Figure 28:
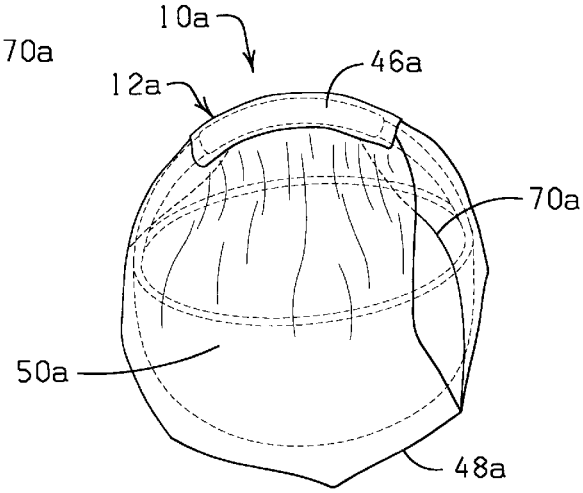
FIG. 28 is a perspective view of the bag of FIG. 26, showing the bag in a position where the bag was opened and a basket was disposed therein, the bag retaining the basket in the retaining space, the bag being closed about and over the handle of the basket, the bag conforming to the contours of the outer surface of the basket contained therein.

A portion of the plurality of side gussets 70*a* may be retained upon closing the bag 12*a*, as shown in FIGS. 27–28, when the first end 46*a* of the bag 12*a* is folded over and closed, or sealed, in any manner or method shown and/or described herein. Alternatively, the first end 46*a* of the bag 12*a* may be crimped and/or twisted (not shown) to obtain a closure, as shown (FIG. 14) and described previously herein. A bonding material 74, or any other means or method of closure known in the art, may be utilized to obtain closure of the bag 12*a*. The bag 12*a*, when closed conforms to the contours and overall shape of the outer surface 90*a* of the basket 84*a* disposed therein.

The Embodiments and Methods of FIGS. 29–33

Shown in FIGS. 29–33 is a bag 12*b* constructed from a first sheet of material 14*b* and a second sheet of material 16*b*, which is similar to the bag 12 and 12*a* formed from first and second sheets of material 14 and 16, and 14*a* and 16*a*, respectively, except that the bag 12*b* has a plurality of side gussets 70*b* having pleating or gathering of the material forming the plurality of side gussets 70*b*.

Figure 29:
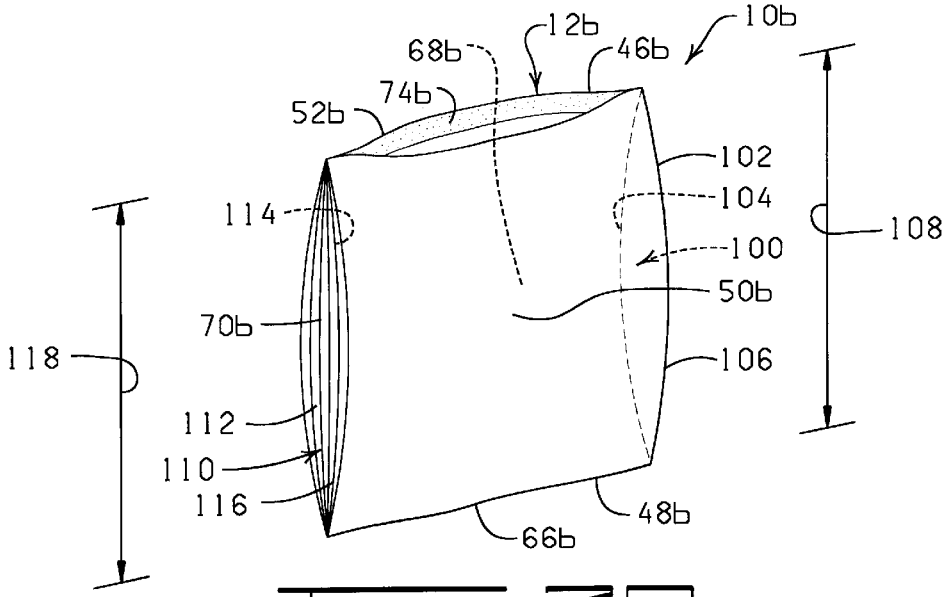
FIG. 29 is a perspective view of the bag formed from a sleeve, showing the bag in a partially flattened position, the bag having a plurality of side gussets having an excess of material, but no bottom gusset.
Figure 30:
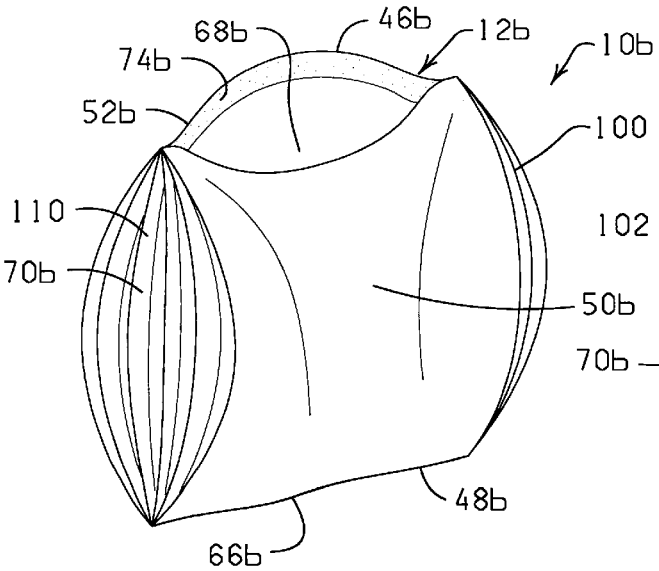
FIG. 30 is a perspective view of the bag of FIG. 29, showing the bag in a partially opened position, the bag having a plurality of side gussets having an excess of material expanding outward to both accept a basket and form a retaining space for a basket.

The first and second sheets of material 14*b* and 16*b* are connected together in a manner identical to that shown and described above for the first and second sheets of material 14 and 16 (FIGS. 29–30). Such a connection resembles sleeves. Such sleeves are disclosed in both U.S. Pat. No. 5,572,851, entitled "Plant Package Having A Detachable Sleeve And Methods", issued to Weder, Nov. 12, 1996, and U.S. Pat. No. 5,625,979, entitled "Sleeve Having A Detachable Portion Forming A Skirt And Methods", issued to Weder, May 6, 1997, which are hereby incorporated by reference herein.

The first sheet of material 14*b* and the second sheet of material 16*b* lay flatwise upon each other, with the lower surface 22*b* of the first sheet of material 14*b* adjacent the upper surface 20*b* of the second sheet of material 16*b* (FIG. 29). Between the first sides 30*b* and 32*b*, respectively, as shown in FIG. 29 is a first gusset 100 whereby the first gusset 100 has an excess of material, in the present instance, the first gusset 100 comprises a pleated material comprising a Z-shaped pleat, referred to herein as an "accordion pleat". It will be appreciated, however, that other pleated patterns, such as, but not by way of limitation, vertical pleats, vertical folds, and other patterns of permitting excess material to expand and contract, may be utilized in the present invention. The first gusset 100 has an outer surface 102, an inner surface 104 and an outer periphery 106. It will be understood that the first gusset 100, and all gussets described herein, may take any form. The first gusset 100 also has a length 108 which, in this instance, extends from the first end 46*b* of the bag 12*b* to the second end 48*b* of the bag 12*b*. The outer periphery 106 of the first gusset 100 connects the first sides 30*b* and 32*b*, respectively, of the first and second sheets of material 14*b* and 16*b*.

Between the second sides 34*b* and 36*b*, respectively, as shown in FIG. 29 is a second gusset 110 whereby the second gusset 110 has an excess of material, identical to that described previously for the first gusset 100. The second gusset 110 has an outer surface 112, an inner surface 114 and an outer periphery 116. The second gusset 110 also has a length 110 which, in this instance, extends from the first end 46*b* of the bag 12*b* to the second end 48*b* of the bag 12*b*. The outer periphery 116 of the second gusset 110 connects the second sides 34*b* and 36*b*, respectively, of the first and second sheets of material 14*b* and 16*b*. It will be appreciated that both first and second gussets 100 and 110, respectively, assist in forming the bag 12*b* and exist as part of the bag 12*b*. The first and second gussets 100 and 110, respectively, are termed, collectively, a plurality of gussets 70*b*, and it will be appreciated that one gusset, or, alternatively, any number of gussets may be utilized to form the bag 12*b* so long as the bag functions as described herein.

In this instance, however, a plurality of side gussets 70*b* are formed, each of which has an excess of material. As noted above, but by way of example only, the material forming the plurality of side gussets 70*b* is pleated in a Z-shaped accordion pleat. All gussets shown herein may be constructed from a separate material, or may be constructed from the same material used to form the first and/or second sheets of material 14*b* and 16*b*. An example of how a gusset may be formed from a separate sheet of material that the material used to form the first and/or second sheets of material 14*b* and 16*b*, respectively, is shown in U.S. Pat. No. 3,380,646, issued to Doyen in FIGS. 9 and 10 and discussion thereof, which is hereby incorporated by reference herein.

A closed bottom 66*b* of the bag 12*b* is formed by sealing the second end 48*b* of the bag 12*b* via a bonding material 74*b* or via any means and/or method known in the art. It will be understood, however, that when the second end 48*b* of the bag 12*b* has one or more gussets, the one or more gussets may share any and/or all of the characteristics of the gussets described herein. Further, it will be understood that any bottom gusset connects to the first sheet of material 14*b* and the second sheet of material 16*b* to form both a gusset and a closure, to form a closed bottom 66*b* of the bag 12*b*.

Figure 31:
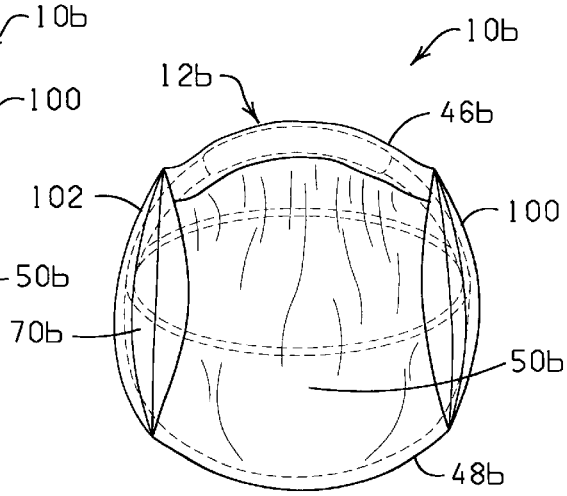
FIG. 31 is a perspective view of the bag of FIGS. 29–30, showing the bag in a position where the bag was opened and a basket was disposed therein, the bag retaining the basket in the retaining space, the bag being closed about and over the handle of the basket, the bag conforming to the contours of the outer surface of the basket contained therein.

In a method of use, when the bag 12*b* is unflattened and opened via the opening 52*b*, the plurality of side gussets 70*b* expand outward, due to the excess of material and the pleating, permitting the bag to be widely opened for the insertion of a basket 84*b*, as shown in FIGS. 30–31. When the basket 84*b* is inserted, it will be appreciated that the pleated material contained within the plurality of side gussets 70*b* expands outward to accommodate the size of the basket 84*b* (FIG. 31), and in a reverse manner, the pleated material contracts and tucks inwardly as well to shape the bag 12*b* about the handle 98*b*, to create a bag 12*b* which contours to the shape of the basket 84*b*. The bag 12*b* is closed and/or sealed via any means and/or method shown and/or described herein, or known in the art.

Figure 32:
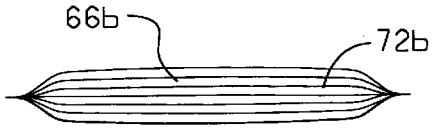
FIG. 32 is a bottom plan view of the bag of FIGS. 29–31, the bag in a flattened position, but having a bottom gusset having an excess of material formed in the bottom of the flattened bag.
Figure 33:
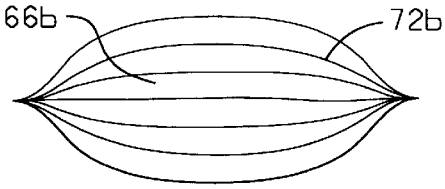
FIG. 33 is a bottom plan view of the bag of FIG. 32, but showing the bottom gusset having excess material expanded to form a retaining space for a basket, the bottom conforming to contours and the overall shape of the lower end of the basket.

It will be understood that the bottom 66*b* of the bag 12*b* may, optionally, as shown in FIGS. 32–33, be formed such that an excess of material which is gathered or pleated is provided, to form a bottom gusset 72*b*. It will be appreciated that when the bottom 66*b* of the bag 12*b* is not expanded, the bottom gusset is flattened, as shown in FIG. 32. When the bottom gusset 72*b* is expanded, such as when the bag 12*b* is opened and a basket 84*b* is contained therein, the bottom gusset 72*b* expands to conform to the contours and the overall shape of the outer surface 90*b* of the lower end 88*b* of the basket 84*b* (FIG. 33).

Figure 34:
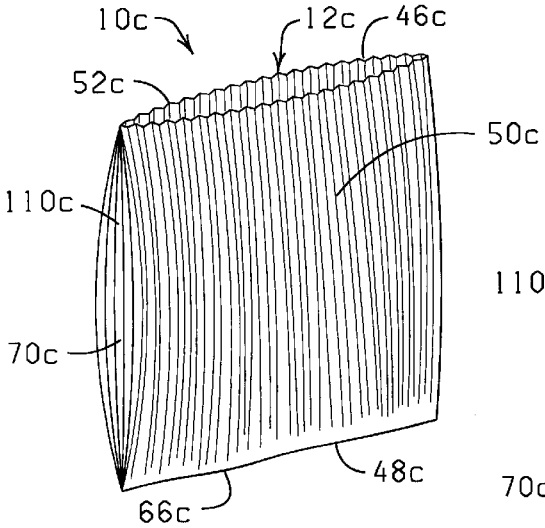
FIG. 34 is a perspective view of yet another alternative bag formed from a sleeve, showing the bag in a partially flattened position, the bag having a plurality of side gussets having an excess of material, but no bottom gusset, the bag formed from a pleated material.
Figure 35:
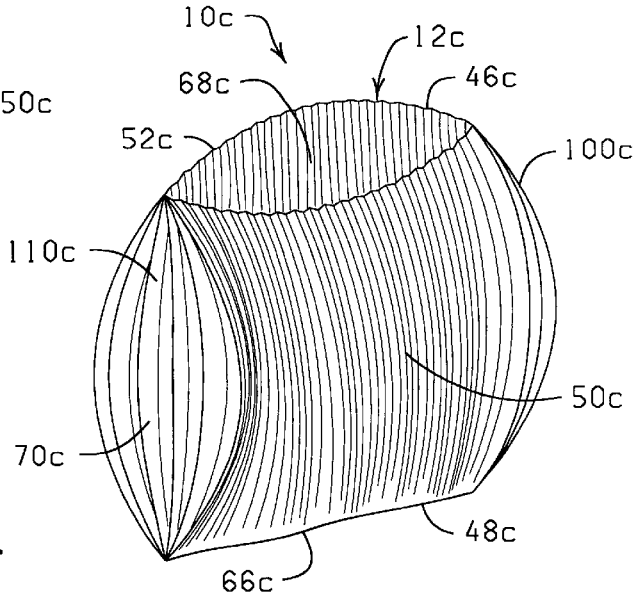
FIG. 35 is a perspective view of the bag of FIG. 34, showing the bag in a partially opened position, the bag having a plurality of side gussets having an excess of material expanding outward to both accept a basket and form a retaining space for a basket.
Figure 36:
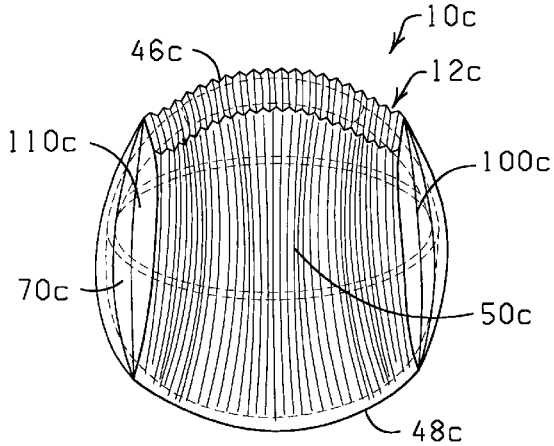
FIG. 36 is a perspective view of the bag of FIGS. 34–35, showing the bag in a position where the bag was opened and a basket was disposed therein, the bag retaining the basket in the retaining space, the bag being closed about and over the handle of the basket, the bag conforming to the contours of the outer surface of the basket contained therein.

The Embodiments and Methods of FIGS. 34–36

Shown in FIGS. 34–36 is a bag 12*c* constructed from a first sheet of material 14*c* and a second sheet of material 16*c*, which is exactly like the bag 12*b* and formed from first and second sheets of material 14*b* and 16*b*, respectively, except that the first and second sheets of material 14*c* and 16*c* have an excess of material and, for instance, but not by way of limitation, are completely pleated in a manner such as, but not by way of limitation, a Z-shaped accordion pleating, creating a bag 12*c* having an outer surface 90*c* and an inner surface 94*c* which has pleating thereabout.

The bag 12*c* has a first gusset 100*c* and a second gusset 100*c* forming a plurality of side gussets 70*c* having pleating or gathering of the material forming the plurality of side gussets 70*c*, as described above for the plurality of gussets 70*b*. The bag 12*c* is formed in a manner identical to that described above for bag 12*b*.

In a method of use, when the bag 12*c* is unflattened and opened via the opening 52*c*, as illustrated in FIG. 35, the pleated excess material, along with the plurality of side gussets 70*c* expand outward, due to the excess of material and the pleating, permitting the bag 12*c* to be widely opened for the insertion of a basket 84*c*. When the basket 84*c* is inserted, as shown in FIG. 36, it will be appreciated that the pleated material contained within the plurality of side gussets 70*c* and the outer surface 90*c* expands outward to accommodate the size of the basket 84*c*, and in a reverse manner, the pleated material contracts and tucks inwardly as well to shape the bag 12*c* about the handle 98*c*, to create a bag 12*c* that conforms to the contours of the overall shape of the outer surface 90*c* of the basket 84*c*. The bag 12*c* is closed and/or sealed via any means and/or method shown and/or described herein, or known in the art. The bag 12*c* may also have a bottom gusset (not shown) which is similar or identical to those bottom gussets described above.

In yet another alternative (not shown), the outer surface 90*c* of the bag 12*c* has pleating, but the plurality of side gussets 70*c* and/or the bottom gusset 72*c* has no pleating, or, alternatively, no excess of material.

The Embodiments and Methods of FIGS. 37–42

Figure 39:
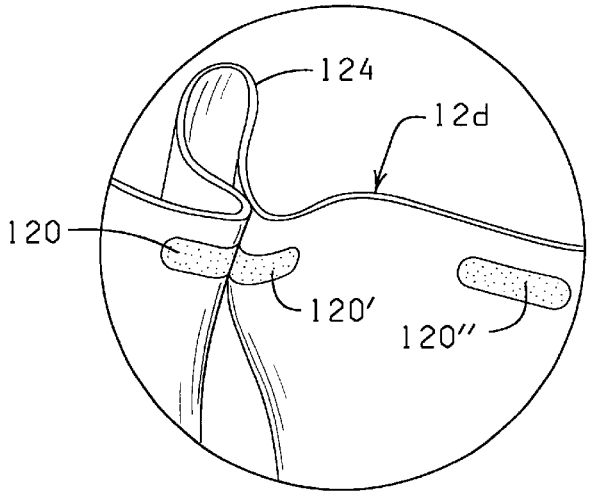
FIG. 39 is a section view of FIG. 38, but showing a plurality of bonding material spots connected together to form one loop of material.
Figure 40:
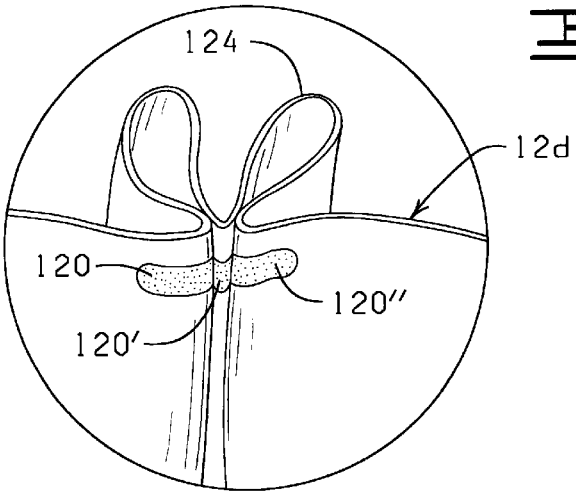
FIG. 40 is a section view of FIG. 39, but showing a plurality of bonding material spots connected together to form two loops of material.
Figure 41:
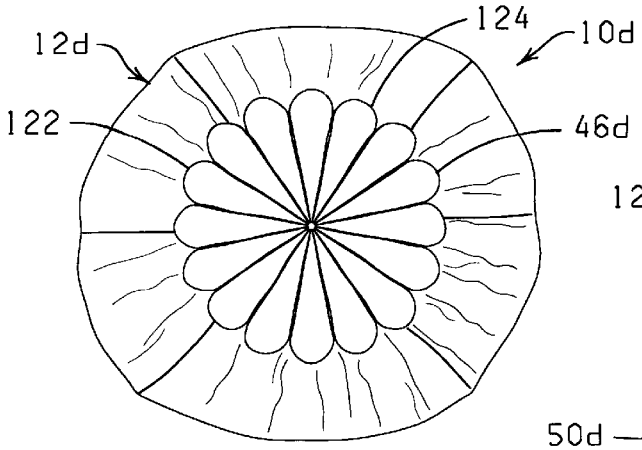
FIG. 41 is an upper plan view of the bag of FIG. 37, but showing the bag holding a basket therein, the upper end of the bag formed into a multi-loop bow.

In another alternative, as shown in FIGS. 37–42, a bonding material 74*d* may be disposed in spots of bonding material 120 about the upper portion of a bag 12*d* such that, when the spots of bonding material 120 are connected together, the first end 46*d* of the bag 12*d* forms a multi-loop bow 122 (FIG. 41).

Figure 37:
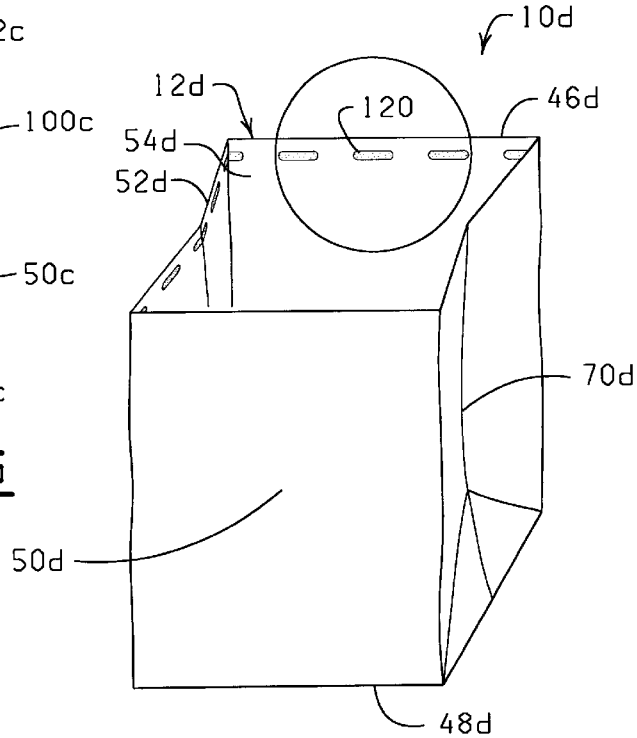
FIG. 37 is a perspective view of the bag of FIG. 7, but showing a plurality of bonding material spots disposed near the opening in the bag, near the upper end.

It will be appreciated that the bag 12*d* may be identical to any bag shown and/or described herein may be used, but for illustration purposes, the bag 12 (shown previously in FIGS. 7 and 12–16) will be utilized. A plurality of bonding material spots 120 are disposed about the opening 52*d* of the bag 12*d*, near the first end 46*d* (FIG. 37). The plurality of bonding material spots 120 are arranged such that the bonding material spots 120 cooperate to provide both a multi-loop bow 122 at the first end 46*d* of the bag 12*d* and/or a closure of the bag 12*d* about a basket 84*d*. It will be understood that the plurality of bonding material spots 120 disposed on the bag 12*d* provide one schematic illustration and example of forming a combined closure and multi-loop bow 122. It will also be appreciated that the plurality of bonding material spots 120 may be arranged in a different manner, and still form a multi-loop bow 122 and/or closure.

Figure 38:
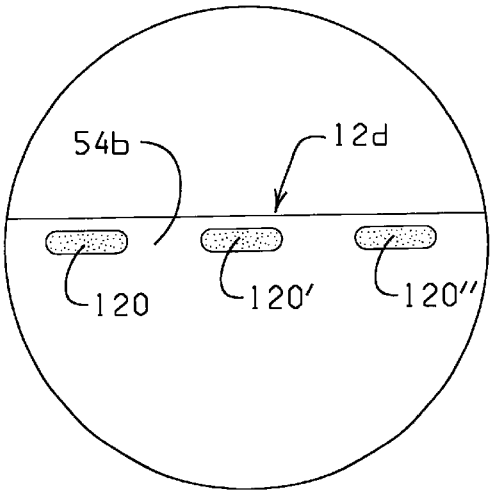
FIG. 38 is a section view defined by the circled area in FIG. 37, slowing the plurality of bonding material spots disposed near the opening in the bag.
Figure 42:
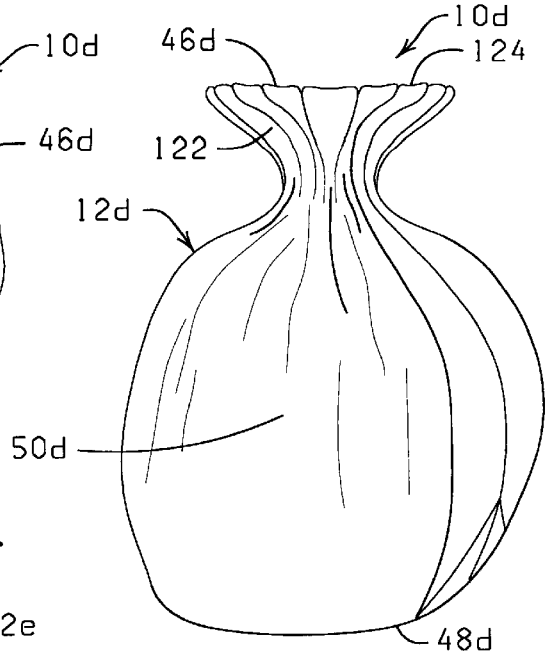
FIG. 42 is a side elevational view of the bag of FIG. 41, showing the bag conforming to the contours of the outer surface of the basket container therein, and having a multi-loop bow which forms the closure of the bag.

The bag 12*d* shown in FIG. 37 and described in detail previously herein has a plurality of oval-shaped bonding material spots 120, which are positioned in a generally symmetrical manner on the inner surface 54*d* of the bag 12*d*, near the opening 52*d* and the first end 46*d*. It will be understood that, in most instance, before the multi-loop bow 122 is formed, the bag 12*d* will have been unflattened and opened and held open for the insertion of the basket 84*d* therein. FIGS. 38–40 show a sectional view of a portion of the bag 12*d*, the sectional view taken from the area encircled in FIG. 37. FIG. 39 shows, in part, the beginning of the formation of the multi-loop bow 122, showing one of the plurality of loops 124 being formed. FIG. 40 shows two of the plurality of loops. It will be appreciated that this process is repeated, until each of the plurality of bonding material spots 120 have been utilized, and the plurality of loops 124 form the multi-loop bow 122 as shown in FIGS. 41–42.

More specifically, as illustrated in FIG. 39, one-half for a bonding material spot 120 is bonded to one-half of another bonding material spot 120' to form one of the plurality of loops 124 (only one of the plurality of loops being designated by the numeral 124) which form the multi-loop bow 122. As illustrated in FIG. 40, one-half of the bonding material spot 120' is then bonded to one-half of bonding material spot 120" to form yet another of the plurality of loops 124. This process is continued, as described above, until all of the plurality of loops 124 form a multi-loop bow 122, as shown in FIGS. 41–42. It will be appreciated that disposing different numbers of the bonding material spots 120 on the bag 12*d,* and/or differing the arrangement of the plurality of bonding material spots 120 on the bag 12*d,* will create multi-loop bows having differing numbers and/or sizes of loops 124.

It will also be understood that the multi-loop bow 122 may create a closure at locations other than the top of the bag 12*d.* For instance, but not by way of limitation, if the bag 12*d* was placed on its side, and a basket 84*d* was disposed in the bag 12*d* in an upright position, then a multi-loop bow 122 would be positioned between the upper end 86*d* and the lower end 88*d* of the basket 84*d* adjacent the outer surface 90*d* of the basket 84*d,* and not necessarily near the handle 98*d* or the upper end 86*d* of the basket 84*d* (not shown).

Figure 43:
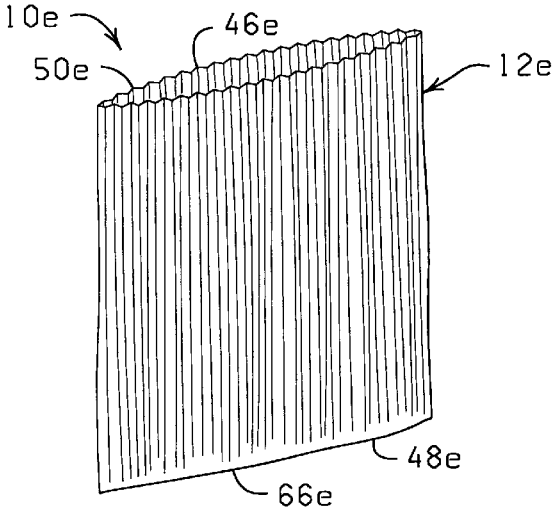
FIG. 43 is a perspective view of yet another alternative bag formed from a sleeve, showing the bag in a partially flattened position, the bag having an excess of material thereabout in the form of a plurality of pleats, but no side gusset or bottom gusset, the bag formed from a pleated material.
Figure 44:
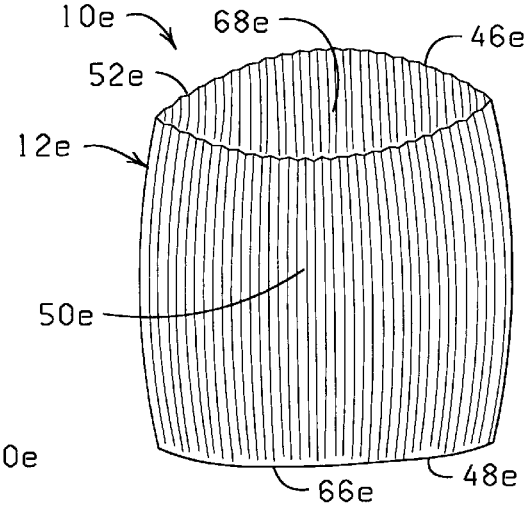
FIG. 44 is a perspective view of the bag of FIG. 43, showing the bag in a partially opened position, the bag having a plurality of pleats expanding outward to both accept a basket and form a retaining space for a basket.
Figure 45:
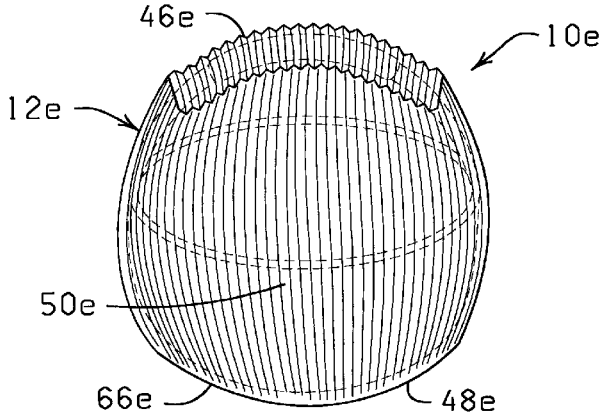
FIG. 45 is a perspective view of the bag of FIGS. 43–44, showing the bag in a position where the bag was opened and a basket was disposed therein, the bag retaining the basket in the retaining space, the bag being closed about and over the handle of the basket, the bag conforming to the contours of the outer surface of the basket contained therein.

The Embodiments and Methods of FIGS. 43–45

Shown in FIGS. 43–45 is a bag 12*e* constructed from a first sheet of material 14*e* and a second sheet of material 16*e,* which is exactly like the bag 12*c* and formed from first and second sheets of material 14*c* and 16*c,* respectively, except that the first and second sheets of material 14*e* and 16*e* have an excess of material and, for instance, but not by way of limitation, are completely pleated in a manner such as, but not by way of limitation, a Z-shaped accordion pleating, creating a bag 12*e* having an outer surface 50*e* and an inner surface 54*e* which has pleating thereabout.

The bag 12*e* in this instance is not like the bag 12*c* because the present bag 12*e* has no plurality of side gussets. The bag 12*e* is formed in a manner identical to that described above for bag 12*b* except for the lack of side gussets; the bag 12*e* has no bottom gussets, either.

In a method of use, when the bag 12*e* is unflattened and opened via the opening 52*e,* as shown in FIG. 44, the pleated excess material expands outward, permitting the bag 12*e* to be widely opened for the insertion of a basket 84*e.* When the basket 84*e* is inserted, it will be appreciated that the pleated material expands outward to accommodate the size of the basket 84*e,* and in a reverse manner, the pleated material contracts and tucks inwardly as well to shape the bag 12*e* about the handle 98*e,* to create a bag 12*e* which follows the overall shape and contours of the outer surface 90*e* of the basket 84*e.* The bag 12*e* is closed and/or sealed via any means and/or method shown and/or described herein, or known in the art.

It will be appreciated that the different variations of gussets disclosed herein may be utilized, alone or in combination, with any of the bags disclosed herein. Similarly, it will be understood that any of the means and methods of providing a closure disclosed herein may be used with any of the bags shown and/or described herein.

Changes may be made in the embodiments of the invention described herein, or in parts or elements of the embodiments described herein, or in the sequence of steps of the methods described herein, without departing from the spirit and/or scope of the invention as defined in the following claims.

What is claimed is:

1. A method for covering a basket, comprising the steps of:

providing a basket having an outer surface;

providing a flattened decorative bag having a first end, a second end, an outer surface, and an opening in the first end, a plurality of gussets disposed in the outer surface between the first end and the second end;

opening the decorative bag such that the opening is sized to receive the basket;

expanding the plurality of gussets to both form a basket retaining space and permit the basket to be disposed within and retained in the basket retaining space; and disposing the basket in the basket retaining space, the decorative bag expanding and contracting via the plurality of gussets, the decorative bag conforming to contours of the outer surface of the basket.

2. The method of claim 1 wherein in the step of providing a flattened decorative bag, the decorative bag is further defined to include a bonding material.

3. The method of claim 2 wherein the bonding material is an adhesive bonding material.

4. The method of claim 2 wherein the bonding material is a cohesive bonding material.

5. The method of claim 1 wherein in the step of providing a flattened decorative bag, the decorative bag is further defined as being constructed from a sheet of material selected from the group consisting of paper, foil, plastic film, metallized film, fabric, fiber, burlap, and any combination thereof.

6. The method of claim 1 wherein in the step of providing a flattened decorative bag, the decorative bag is further defined as having characteristics selected from the group consisting of decorations, colorings, coatings, embossings, flockings, metallic finishes, pearlescent finishes, translucent finishes, transparent finishes, iridescent finishes, neon finishes, holographic finishes, holographic designs, opaque finishes, clear finishes, and any combination thereof.

7. The method of claim 1 wherein in the step of providing a flattened decorative bag, the flattened decorative bag is further defined as being constructed from a sheet of material having a thickness in a range of about 0.5 mils to about 10 mils.

8. The method of claim 1 wherein in the step of disposing the basket in the decorative bag, the step further includes closing the decorative bag about a handle of the basket.

9. The method of claim 1 wherein in the step of disposing the basket in the decorative bag, the step further includes closing the decorative bag about the basket via the formation of a multi-loop bow.

10. The method of claim 1 wherein in the step of disposing the basket in the decorative bag, the step further includes closing the decorative bag about the basket above the level of a handle on the basket.

11. The method of claim 1 wherein in the step of providing a flattened decorative bag, the plurality of gussets in the decorative bag are further defined as comprising pleats.

12. The method of claim 1 wherein in the step of providing a flattened decorative bag, the decorative bag is further defined as comprising at least one gusset disposed in the second end.

13. The method of claim 12 wherein the at least one gusset in the second end is further defined as comprising pleats.

14. A method for covering a basket, comprising the steps of:

providing a basket having a lower end and an outer surface;

providing a flattened decorative bag having a first end, a second end having a plurality of gussets disposed in the second end, an outer surface, and an opening in the first end;

opening the decorative bag such that the opening is sized to receive the basket;

expanding the plurality of gussets to both form a basket retaining space and permit the basket to be disposed within and retained in the basket retaining space; and disposing the basket in the basket retaining space, the decorative bag expanding and contracting via the plurality of gussets and conforming to contours of the outer surface of the second end of the basket.

15. The method of claim 14 wherein in the step of providing a flattened decorative bag, the decorative bag is further defined to include a bonding material.

16. The method of claim 15 wherein the bonding material is an adhesive bonding material.

17. The method of claim 15 wherein the bonding material is a cohesive bonding material.

18. The method of claim 14 wherein in the step of providing a flattened decorative bag, the decorative bag is further defined as being constructed from a sheet of material selected from the group consisting of paper, foil, plastic film, metallized film, fabric, fiber, burlap, and any combination thereof.

19. The method of claim 14 wherein in the step of providing a flattened decorative bag, the decorative bag is further defined as having characteristics selected from the group consisting of decorations, colorings, coatings, embossings, flockings, metallic finishes, pearlescent finishes, translucent finishes, transparent finishes, iridescent finishes, neon finishes, holographic finishes, holographic designs, opaque finishes, clear finishes, and any combination thereof.

20. The method of claim 14 wherein in the step of providing a flattened decorative bag, the flattened decorative bag is further defined as being constructed from a sheet of material having a thickness in a range of about 0.5 mils to about 10 mils.

21. The method of claim 14 wherein in the step of disposing the basket in the decorative bag, the step further includes closing the decorative bag about a handle of the basket.

22. The method of claim 14 wherein in the step of disposing the basket in the decorative bag, the step further includes closing the decorative bag about the basket via the formation of a multi-loop bow.

23. The method of claim 14 wherein in the step of disposing the basket in the decorative bag, the step further includes closing the decorative bag about the basket above the level of a handle on the basket.

24. The method of claim 14 wherein in the step of providing a flattened decorative bag, the plurality of gussets in the second end of the decorative bag is further defined as comprising pleats.

25. The method of claim 14 wherein in the step of providing a flattened decorative bag, the decorative bag is further defined as having a plurality of gussets disposed in the outer surface between the first end and the second end of the decorative bag.

26. The method of claim 25 wherein the plurality of gussets are further defined as comprising an excess of material comprising pleats.

27. A method for covering a basket, comprising the steps of:

providing a basket having an outer surface;

providing a flattened decorative bag having a first end, a second end, an outer surface, and an opening in the upper end, the decorative bag formed from a plurality of folds, the plurality of folds substantially flattened when the decorative bag is not retaining a basket therein, the plurality of folds expanding when the decorative bag is opened, the plurality of folds conforming to contours of a basket when a basket is disposed in the decorative bag;

opening the decorative bag such that the opening is sized to receive a basket;

expanding the plurality of folds to both form a basket retaining space and permit the basket to be disposed within and retained in the basket retaining space; and disposing the basket in the basket retaining space, the decorative bag expanding and contracting via the plurality of folds, the decorative bag conforming to contours of the outer surface of the basket.

28. The method of claim 27 wherein in the step of providing a flattened decorative bag, the flattened decorative bag is further defined to include a bonding material.

29. The method of claim 28 wherein the bonding material is an adhesive bonding material.

30. The method of claim 28 wherein the bonding material is a cohesive bonding material.

31. The method of claim 27 wherein in the step of providing a flattened decorative bag, the decorative bag is further defined as being constructed from a sheet of material selected from the group consisting of paper, foil, plastic film, metallized film, fabric, fiber, burlap, and any combination thereof.

32. The method of claim 27 wherein in the step of providing a flattened decorative bag, the decorative bag is further defined as having characteristics selected from the group consisting of decorations, colorings, coatings, embossings, flockings, metallic finishes, pearlescent finishes, translucent finishes, transparent finishes, iridescent finishes, neon finishes, holographic finishes, holographic designs, opaque finishes, clear finishes, and any combination thereof.

33. The method of claim 27 wherein in the step of providing a flattened decorative bag, the flattened decorative bag is further defined as being constructed from a sheet of material having a thickness in a range of about 0.5 mils to about 10 mils.

34. The method of claim 27 wherein in the step of disposing the basket in the decorative bag, the step further includes closing the decorative bag about a handle of the basket.

35. The method of claim 27 wherein in the step of disposing the basket in the decorative bag, the step further includes closing the decorative bag about the basket via the formation of a multi-loop bow.

36. The method of claim 27 wherein in the step of disposing the basket in the decorative bag, the step further includes closing the decorative bag about the basket above the level of a handle on the basket.

* * * * *